United States Patent [19]

Pessina et al.

[11] Patent Number: 4,674,733

[45] Date of Patent: Jun. 23, 1987

[54] LOADER FOR SIGNATURES AND THE LIKE

[76] Inventors: Giorgio Pessina; Aldo Perobelli, both of Via Timavo, 32, Paderno Dugnano (Milano), Italy

[21] Appl. No.: 762,141

[22] Filed: Aug. 2, 1985

Related U.S. Application Data

[63] Continuation of Ser. No. 462,135, Jan. 31, 1983, abandoned.

[30] Foreign Application Priority Data

Feb. 3, 1982 [IT] Italy ..... 19424 A/82

[51] Int. Cl.[4] ..... B65H 5/22

[52] U.S. Cl. ..... 271/3.1; 271/35; 271/94

[58] Field of Search ..... 271/3.1, 5–7, 271/35, 94–96; 198/689, 493; 414/37, 128, 130; 270/58

[56] References Cited

U.S. PATENT DOCUMENTS

| | | | |
|---|---|---|---|
| 3,680,854 | 8/1972 | Daily et al. | 271/32 |
| 4,081,181 | 3/1978 | Crowe et al. | 271/3.1 |
| 4,270,746 | 6/1981 | Hamlin | 271/35 |
| 4,399,675 | 8/1983 | Erdmann et al. | 271/227 |

*Primary Examiner*—Douglas C. Butler

*Attorney, Agent, or Firm*—Bucknam and Archer

[57] ABSTRACT

Loader for signatures and the like, comprises, between the signature feeding path and the signature raising path, a step capable of breaking and dividing the signature pack, so as to form a stack portion of very reduced weight. The adhesion of the signatures to be conveyed on the raising path is improved by applying a negative pressure. There is further provided a sensor for detecting the presence of signatures on the raising path which sensor is swingably supported and is capable of acting as an abutment for the signatures forming the pack portion.

1 Claim, 2 Drawing Figures

LOADER FOR SIGNATURES AND THE LIKE

This is a continuation of application Ser. No. 462,135, filed Jan. 31, 1983, now abandoned.

BACKGROUND OF THE INVENTION

The present invention relates to loaders for conveying signatures and the like.

There are already known loader devices for conveying or transporting signatures.

The known devices generally comprises an supporting frame housing a horizontally extending path for feeding the signature packs which are then raised along another path, the feeding and raising paths consisting of belts or the like extending between driving and driven rollers. Above the raising path there is provided a raising frame, which latter consists of a belt extending about pulleys in such a way as to suitably arrange the signatures. The raising frame is longitudinally movably supported, in order to fit with signatures of different size. This construction is known for example from the U.S. Pat. No. 3,894,732.

In the known signature loaders it occurs that on the first signatures near the raising path and in particular on the leading signature, a very high pushing force is exerted, which, on one hand, is due to the weight or the signatures themselves, which are slightly forwardly slanted and, on the other hand, it is due to the entraining action on the signature pack exerted by the conveyor belts.

Thus a rather high friction occurs, in particular with respect to the first signatures, as well as between the first signature sheet contacting the raising path, which path subjects the first signature sheet to a drawing action, and the last sheet of the first signature, which is pressed by the pack located downstream, so that the first signature, that is the leading one, tends to slip away on the last sheet held by the feeding pack. Thus there occur the so-called "autoexfoliation" phenomena of the signatures, which phenomena are more intense when the signatures comprise a great number of sheets, which number may amount to 60–70 pages and more.

In order to overcome the drawback mentioned hereinabove, it has been proposed to provide, at one end of the horizontally extending feeding path, a short portion of slanted feeding, capable on one hand, of slightly reducing the pushing force due to the pack weight, by slanting in front in a greater amount the signatures, and, on the other hand, capable of further reducing the pushing force, by discharging a portion on the first driving or transmission roller.

In actual practice it has however been found that the mentioned approach does not permit the signature conveying problem to be efficiently solved, in particular in the case of signatures difficult to handle, such as the illustrated magazine signatures, or the signatures including a a great number of sheets, and in the case of signatures open on at three sides.

Moreover in the known loaders, operation unevennesses occur because of the different friction exerted on the signatures depending on the paper type and the printing marks, in a single colour or in multiple colours, as well on the spreading on the signature of the printed zones.

The operation unevennesses mentioned hereinabove generally consist of a bad drawing or the signatures from the signature pack, so that the signatures are erroneously located on the conveyor belts, with the consequent requirement of intervention by the operating personnel. Moreover the known loaders may hardly be fitted to different sizes of signatures.

Still another drawback of the known signature loaders is that they require mechanical elements for preadjusting the signature pack at the raising zone since, by way of an example, in the case of the so-called bound signatures or signatures provided with three open or cut sides, the front portion of the signature pack, upon breaking the binding element, which generally consists of a plastics strip, tends to assume a misaligned fan shape, so that the signatures are conveyed to the raising pulleys with an uneven arrangement susceptible to cause the signatures to move in an erroneous slanted direction.

SUMMARY

Accordingly, one object of the present invention is to provide a signature loader capable of affording the possibility of overcoming the drawbacks of the known signature loaders mentioned hereinabove, while being capable of efficiently and reliably operating with any types of signatures, independently from the paper quality, the printed marks thereon, the sheet number, the number of open sides of the signatures and from other parameters contraddistinguishing the different signatures.

It is a primary object of the present invention to provide a signature conveying method effective to allow for the signatures to be quickly and easily conveyed always in a perfectly ordered way.

According to one aspect of the present invention, the thereinabove mentioned task and object, as well as yet other objects which will become more apparent thereinafter, are achieved by a loader for signatures and the like, comprising a supporting frame, a substantially horizontally extending signature feeding path, possibly provided with an upwardly slanted end portion, an inclined surface or chute for raising the signatures and associated frames and signature raising belt members, as well as driving means therefor, characterized in that at the end of the signature feeding path, or of the slanted portion thereof for the pack of signatures, between said slanted portion and the path for raising said signatures, there is provided a step member effective to break and fractionate said pack, said signature raising path beginning under said step member, means effective to bear said signatures in said breaking and fractionating step member, and a sensor effective to detect the presence of said signatures upstream of the driving pulleys of said raising frame, and pneumatic means for preopening said signatures, as well as further pneumatic means effective to improve the adhesion of said signatures on the raising belts.

BRIEF DESCRIPTION OF THE DRAWINGS

Further characteristics and advantages of the signature loader according to the present invention will become more apparent hereinafter from the following detailed description of a preferred embodiment thereof, with reference to the accompanying drawing, where.

DESCRIPTION OF THE PREFERRED EMBODIMENTS

Figures 1, 2:
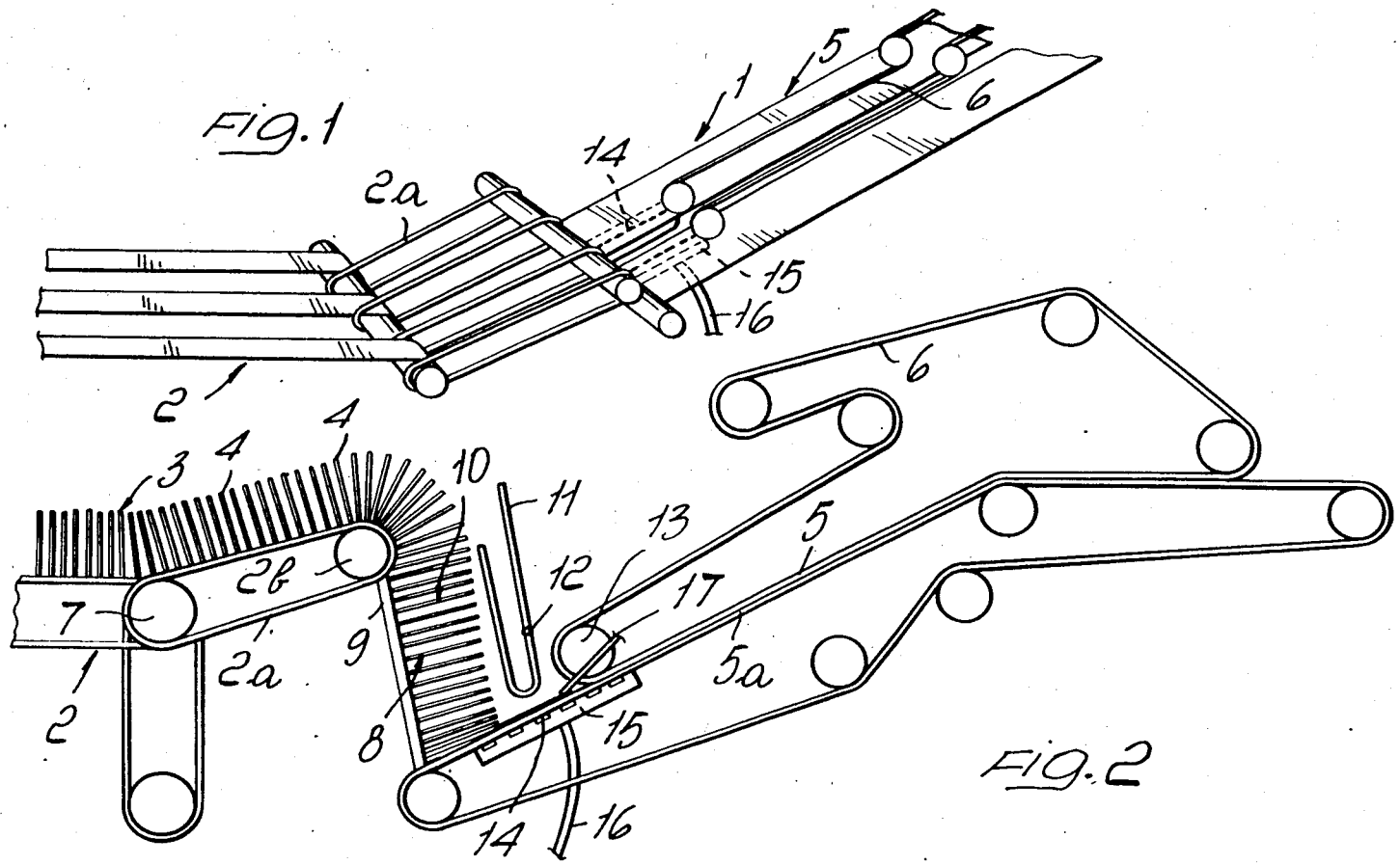
FIG. 1 is a perspective view of the loader portion according to the present invention.
FIG. 2 is a side view of a signature loader according to the present invention.

With reference to the drawing, the signature loader according to the present invention is herein indicated overally by 1.

The loader consists, in a known way, of a feeding path 2 for feeding the pack 3 of signatures 4 and of a path 5 for raising said signatures 4. Said signatures may have any desired size and number of open sides. With the signature raising path 5 there is associated a frame 6 for raising said signatures, which frame, likewise said signature feeding path 2 may comprise, for example, a carpet or belts. By means of the mentioned signature raising frame 6, the signatures are conveyed on the path 5 with the "known shingle or imbricated arrangement".

As it will be clear from the drawing, the feeding path 2 is provided, in the considered example, with a slightly upwardly slanted end portion 2*a*, in a known way. In the exemplary illustrated embodiment, the movement of the belts of the feeding path 2 and the slanted portion thereof 2*a* is obtained through the motor driven roller 7, the required slightly different speeds of the horizontal and slanted belts being obtained by using different diameter transmission rollers.

According to the present invention, at the end of the slanted portion 2*a* of the signature 4 pack 3 feeding path 2, between the latter and the signature raising path 5, there is provided a step member 8, effective to break and divide or "fractionate" the signature pack 3. As it will be clear from the drawing, under the mentioned step member 8 there is provided the starting portion of the signature raising path 5. At 9 there has been indicated a signature bearing member thereon the signatures 4 will rest or bear upon falling into the step member 8, which bearing member 9 is specifically provided for suitably prearranging the leading portion of the signature pack to be raised.

Further according to the present invention, in order to provide a locating abutment for the pack signatures falling to form the leading portion, there is provided an abutment member 11, swingably supported at the pivot 12, fixed to the sides (not shown) of the supporting frame (not shown) of the signature feeding path the abutment member being also capable of operating as a sensor capable of detecting the presence of the signatures to be supplied.

Said sensor, in a signature exhausting condition, will drive or control the driving motor for driving the feeding path 2 or 2*a*. That sensor, as it is particularly clearly illustrated in FIG. 2, is located just upstream of the transmission pulleys 13 of the raising frame nearer to said oblique slanted portion 2*a*.

At 14 there have been indicated in the drawing holes formed through the sheet metal panel 5*a* of the raising path and leading, through a respective manifold chamber, indicated at 15, to a duct 16, which is coupled to a negative pressure source, not specifically shown.

According to the present invention, also the raising belts are longitudinally provided with holes which are spaced by a pitch corresponding, for example, to that of the mentioned holes 14.

According to the invention, moreover, in order to assure an even take up of the signatures 4, means are provided for blowing pressurized air at the signatures near to the pulleys 13, thereby reducing the weight of the leading or head pack portion 10. This is achieved, in the illustrated embodiment, by providing on either side of said pulleys 13, respectively a pressurized air supplying nozzle 17, coupled to a pressurized air source (not shown), the jet whereof is oriented towards the first lower signatures of the portion 10.

The operation of the subject signature loader will be evident from the above description jointly to the accompanying drawing.

More specifically, during the operation of the piling device, the front portion of the signature 4 pack 3, as it arrives at the front transmission roller 2*b* of the feeding path, is rotated frontwardly, thereby falling by gravity into the step member 8 in such a way as to locate on the signature portion which is present herein. Said portion forms the signature portion 10 which comprises the signature pack proper, which latter is practically separated from the starting feeding pack, thereby it is not subjected to the loading thereof.

The mentioned leading portion is of a rather reduced height and, accordingly, it has a negligible weight.

It should be moreover pointed out that the bearing member 9, jointly to the abutment 11, which latter, according to the invention, is also effective to operate as a sensor, assures a quick and sure building of the leading portion 10. The weight, which is a very reduced one, of the leading portion 10 is further neutralized by means of a pressurized air jet supplied by the nozzles 17 and acting for rising the leading portion 10 including the signatures to be removed, and providing a preopening of said signatures. Thus a very even feeding is assured and the removed signatures are evenly conveyed in a shingle type of flow.

By the subject loader and the indicated method for handling signatures, it will be possible to solve the thereinabove mentioned task perfectly and independently from the signature type.

It should also be noted that the abutment 11, which is also effective to operate as a sensor for detecting the presence of signatures, is advantageously swingably supported on the frame 6, thereby eliminating adjusting operations as different size signatures are handled.

In practicing the invention, several modifications and variations can be made without departing from its scope. For example it would be possible to use a bearing member 9 having a different slanting from that which has been illustrated, as well as to provide, upstream of said member, a feeding path of any suitable configuration.

Moreover, while in the exemplary embodiment a negative pressure has been used for improving the adhesion of the signatures on the raising belts, satisfactory results may be practically achieved also in the case therein such an arrangement is applied to the known signature loader, without any provisions of the step member.

In practicing the invention all of the individual parts may be replaced by technically and/or operatively equivalent components, without departing from the scope of the invention.

Finally, it should also be noted that all of the characteristics which may be deduced from the disclosure, claims and drawing are to be considered as substantial for the invention, either individually or in combination.

We claim:

1. In a loader for signatures comprising a supporting frame, a horizontally extending path for feeding a pack of signatures, an upwardly slanted path for raising said signatures, arranged downstream of said horizontally extending path, a plurality of pressurized air nozzles and signature adhesion improving pneumatic means associated with said upwardly slanted path, the improvement wherein there is provided, immediately after said horizontally extending path, a further upwardly slanted path, so designed and arranged as to fractionate said pack of signatures and, between said further upwardly slanted path and said upwardly slanted path for raising said signatures, a step member so designed and arranged as to further fractionate said pack of signatures, a signature bearing downwardly slanted wall member being further provided adjacent said step member and extending between the end of said further upwardly slanted path and said upwardly slanted path for raising said signatures.

* * * * *